US006845819B2

(12) United States Patent
Barrett et al.

(10) Patent No.: US 6,845,819 B2
(45) **Date of Patent: *Jan. 25, 2005**

(54) DOWN HOLE TOOL AND METHOD

(75) Inventors: Michael P. Barrett, Histon (GB); Stuart I. Jardine, Cambridge (GB); Michael C. Sheppard, Castle Camps (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/105,836

(22) Filed: Mar. 25, 2002

(65) Prior Publication Data

US 2002/0096322 A1 Jul. 25, 2002

Related U.S. Application Data

(63) Continuation of application No. 09/101,453, filed on Aug. 19, 1998, now Pat. No. 6,405,798.

(30) Foreign Application Priority Data

Jul. 13, 1996 (GB) ..... 9614761

(51) Int. Cl.[7] ..... E21B 44/00
(52) U.S. Cl. ..... 166/250.01; 166/53; 166/66.7
(58) Field of Search ..... 166/250.01, 254.2, 166/55, 55.7, 55.8, 53, 65.1, 66.7, 104, 177.2; 324/76.11; 175/92, 93, 94, 104, 106

(56) References Cited

U.S. PATENT DOCUMENTS

| | | | | |
|---|---|---|---|---|
| 3,225,843 A | 12/1965 | Ortloff et al. | | |
| 3,313,346 A | 4/1967 | Cross | | |
| 3,724,567 A | 4/1973 | Smitherman | | |
| 3,827,512 A | 8/1974 | Edmond | | |
| 3,937,278 A | 2/1976 | Sheshtawy | ..... | 166/63 |
| 4,006,359 A | 2/1977 | Sullins et al. | | |
| 4,050,384 A | 9/1977 | Chapman | | |
| 4,071,086 A | 1/1978 | Bennett | | |
| 4,085,808 A | 4/1978 | Kling | ..... | 175/94 |

(List continued on next page.)

FOREIGN PATENT DOCUMENTS

| | | | | |
|---|---|---|---|---|
| BR | PI 9706796-2 A | 9/1997 | ..... | E21B/47/00 |
| DE | DAS 1084801 | 2/1956 | ..... | H02G/19/08 |

(List continued on next page.)

OTHER PUBLICATIONS

Euro Robotics & Intell Sys Conf, (1994), pp. 1156–1161, D. S. Cooke et al., "Pirov–Pipe Insertion Remotely Operated Vehicle for Inspecting Nuclear Reactor Internals".

(List continued on next page.)

*Primary Examiner*—Frank Tsay
(74) *Attorney, Agent, or Firm*—William L. Wang; William B. Batzer; John J. Ryberg

(57) ABSTRACT

A down hole tool and apparatus is described for logging and/or remedial operations in a wellbore in a hydrocarbon reservoir. The tool comprises an autonomous unit for measuring down hole conditions, preferably flow conditions. The autonomous unit comprises locomotion means for providing a motion along the wellbore; means for detecting the down hole conditions; and logic means for controlling the unit, the logic means being capable of making decisions based on at least two input parameters. It can be separably attached to a wireline unit connected to the surface or launched from the surface. The connection system between both units can be repeatedly operated under down hole conditions and preferably includes an active component for closing and/or breaking the connection.

24 Claims, 7 Drawing Sheets

U.S. PATENT DOCUMENTS

| | | | | |
|---|---|---|---|---|
| 4,112,850 | A | | 9/1978 | Sigel-Gfeller |
| 4,141,414 | A | | 2/1979 | Johansson |
| 4,177,734 | A | | 12/1979 | Rhoden |
| 4,192,380 | A | | 3/1980 | Smith ..... 166/250 |
| 4,243,099 | A | | 1/1981 | Rodgers, Jr. |
| 4,244,296 | A | | 1/1981 | Vertut |
| 4,369,713 | A | | 1/1983 | Richardson |
| 4,378,051 | A | | 3/1983 | Cholet et al. ..... 166/383 |
| 4,463,814 | A | | 8/1984 | Horstmeyer et al. |
| 4,509,593 | A | | 4/1985 | Traver et al. ..... 166/63 |
| 4,537,136 | A | | 8/1985 | Douglas |
| 4,558,751 | A | | 12/1985 | Huffaker |
| 4,565,487 | A | | 1/1986 | Kroczynski ..... 414/730 |
| 4,624,306 | A | | 11/1986 | Traver et al. ..... 414/730 |
| 4,630,243 | A | | 12/1986 | MacLeod ..... 367/82 |
| 4,648,454 | A | | 3/1987 | Yarnell ..... 166/297 |
| 4,676,310 | A | | 6/1987 | Scherbatskoy et al. .... 166/65.1 |
| 4,686,653 | A | | 8/1987 | Staron et al. |
| 4,770,105 | A | | 9/1988 | Takagi et al. |
| 4,805,951 | A | | 2/1989 | Andersson et al. ..... 294/116 |
| 4,819,721 | A | | 4/1989 | Long, Jr. |
| 4,838,170 | A | | 6/1989 | Illakowicz |
| 4,860,581 | A | | 8/1989 | Zimmerman et al. ..... 73/155 |
| 4,862,808 | A | | 9/1989 | Hedgcoxe et al. ..... 104/138 |
| 4,914,944 | A | | 4/1990 | Herron et al. ..... 73/152 |
| 4,919,223 | A | | 4/1990 | Egger et al. |
| 4,939,648 | A | * | 7/1990 | O'Neill et al. ..... 364/422 |
| 4,940,095 | A | | 7/1990 | Newman |
| 4,986,314 | A | | 1/1991 | Himmler |
| 5,018,451 | A | | 5/1991 | Hapstack |
| 5,080,020 | A | | 1/1992 | Negishi |
| 5,111,401 | A | | 5/1992 | Everett, Jr. et al. ..... 364/424.02 |
| 5,121,694 | A | | 6/1992 | Zollinger |
| 5,142,989 | A | | 9/1992 | Suzumori et al. |
| 5,142,990 | A | | 9/1992 | Leonard |
| 5,172,639 | A | | 12/1992 | Wiesman et al. |
| 5,184,676 | A | | 2/1993 | Graham et al. |
| 5,186,264 | A | | 2/1993 | du Chaffaut ..... 175/27 |
| 5,203,646 | A | | 4/1993 | Landsberger et al. ..... 405/191 |
| 5,210,821 | A | | 5/1993 | Yazaki et al. ..... 395/83 |
| 5,220,869 | A | | 6/1993 | Pelrine et al. |
| 5,254,835 | A | | 10/1993 | Dalke et al. ..... 219/125.11 |
| 5,272,986 | A | | 12/1993 | Smart |
| 5,291,112 | A | | 3/1994 | Karidis et al. ..... 318/568 |
| 5,293,823 | A | | 3/1994 | Box ..... 104/138 |
| 5,309,844 | A | | 5/1994 | Zollinger |
| 5,316,094 | A | | 5/1994 | Pringle ..... 175/54 |
| 5,318,136 | A | | 6/1994 | Rowsell et al. ..... 175/24 |
| 5,350,033 | A | | 9/1994 | Kraft ..... 180/167 |
| 5,373,898 | A | | 12/1994 | Pringle ..... 166/72 |
| 5,375,530 | A | | 12/1994 | Zollinger et al. |
| 5,388,528 | A | | 2/1995 | Pelrine et al. |
| 5,390,748 | A | | 2/1995 | Goldman ..... 175/24 |
| 5,392,715 | A | | 2/1995 | Pelrine ..... 104/138.2 |
| 5,394,951 | A | | 3/1995 | Pringle et al. ..... 175/45 |
| 5,417,295 | A | | 5/1995 | Rao et al. ..... 175/40 |
| 5,435,395 | A | | 7/1995 | Connell |
| 5,452,761 | A | | 9/1995 | Beard et al. ..... 166/250 |
| 5,706,892 | A | | 1/1998 | Aeschbacher, Jr. et al. |
| 5,706,896 | A | | 1/1998 | Tubel et al. ..... 166/313 |
| 5,732,776 | A | | 3/1998 | Tubel et al. |
| 5,794,703 | A | | 8/1998 | Newman et al. |
| 5,812,068 | A | | 9/1998 | Wisler et al. |
| 5,829,520 | A | | 11/1998 | Johnson |
| 5,842,149 | A | | 11/1998 | Harrell et al. |
| 5,947,213 | A | | 9/1999 | Angle et al. ..... 175/24 |
| 5,974,348 | A | | 10/1999 | Rocks ..... 701/28 |
| 6,003,606 | A | | 12/1999 | Moore et al. |
| 6,009,359 | A | | 12/1999 | El-Hakim et al. ..... 701/28 |
| 6,026,911 | A | | 2/2000 | Angle et al. ..... 175/24 |
| 6,031,371 | A | | 2/2000 | Smartg ..... 324/220 |
| 6,041,860 | A | | 3/2000 | Nazzal et al. ..... 166/250.01 |
| 6,089,512 | A | | 7/2000 | Ansorge et al. ..... 246/194 |
| 6,112,809 | A | | 9/2000 | Angle ..... 166/66 |

FOREIGN PATENT DOCUMENTS

| | | | | |
|---|---|---|---|---|
| DE | 2358371 | A1 | 11/1973 | ..... E21B/23/00 |
| DE | 18534696 | A1 | 9/1995 | ..... E21B/47/00 |
| EP | 177 112 | A2 | 4/1985 | ..... F16L/55/00 |
| EP | 149 528 | | 7/1985 | |
| EP | 206 706 | A2 | 6/1986 | ..... G01V/3/24 |
| EP | 367 633 | A2 | 11/1989 | ..... F16L/55/162 |
| EP | 559 565 | A1 | 3/1993 | ..... E21B/23/02 |
| GB | 2301414 | A * | 5/1995 | |
| WO | WO 92/18746 | | 4/1992 | ..... E21B/33/02 |
| WO | 96/24745 | | 8/1996 | |
| WO | WO 98/02634 | | 7/1997 | ..... E21B/23/00 |
| WO | WO 98/12418 | | 9/1997 | ..... E21B/47/00 |

OTHER PUBLICATIONS

Automation & Robotics in Construction XI, (1994), pp. 441–447, Y. Kimura et al., "Development of a Fully Automatic Robotic System for Small Diameter Tunnel Construction: Development of the ACE MOLE 1200–M2 Construction Method".

Proc. of the 1993 IEEE/RSJ Int'l Conf on Intell Robots and Sys, (1993), vol. 1, pp. 509–516, S. Fujiwara et al., "An Articulated Multi–Vehicle Robot for Inspection and Testing of Pipeline Interiors".

OFFSHORE, Dec. 1999, pp. 101–102, W. Furlow, "Wireless Tractor Enters Flowing Well to Conduct Repairs".

IFAC Intelligent Autonomous Vehicles, (1995), pp. 295–300, H. Makela et al., "Navigation System for LHD Machines".

Gary Rich et al, Rotary closed loop drilling system designed for the next millennium, May 1997 Hart's Petroleum Engineer International pp. 47–53.

* cited by examiner

DOWN HOLE TOOL AND METHOD

This application is a continuation of Ser. No. 09/101,453 filed on Aug. 19, 1998 now U.S. Pat. No. 6,405,798.

The present invention relates to down hole tools and methods for measuring formation properties and/or inspecting or manipulating the inner wall or casing of a wellbore. In particular, it relates to such tools and methods for use in horizontal or high-angle wells.

BACKGROUND OF THE INVENTION

With the emergence of an increasing number of non-vertically drilled wells for the exploration and recovery of hydrocarbon reservoirs, the industry today experiences a demand for logging tools suitable for deployment in such wells.

The conventional wireline technology is well established throughout the industry. The basic elements of down hole or logging tools are described in numerous documents. In the U.S. Pat. No. 4,860,581, for example, there is described a down hole tool of modular construction which can be lowered into the wellbore by a wire line. The various modules of the tool provide means for measuring formation properties such as electrical resistivity, density, porosity, permeability, sonic velocities, density, gamma ray absorption, formation strength and various other characteristic properties. Other modules of the tool provide means for determining the flow characteristics in the well bore. Further modules include electrical and hydraulic power supplies and motors to control and actuate the sensors and probe assemblies. Generally, control signals, measurement data, and electrical power are transferred to and from the logging tool via the wireline. This and other logging tools are well known in the industry.

Though the established wireline technology is highly successful and cost-effective when applied to vertical boreholes, it fails for obvious reasons when applied to horizontal wells.

In a known approach to overcome this problem, the logging tool is mounted to the lowermost part of a drill pipe or coiled tubing string and thus carried to the desired location within the well.

This method however relies on extensive equipment which has to be deployed and erected close to the bore hole in a very time-consuming effort. Therefore the industry is very reluctant in using this method, which established itself mainly due to a lack of alternatives.

In a further attempt to overcome these problems, it has been suggested to combine the logging tool with an apparatus for pulling the wireline cable through inclined or horizontal sections of the wellbore. A short description of these solutions can be found in U.S. Pat. No. 4,676,310, which itself relates to a cableless variant of a logging device.

The cableless device of the U.S. Pat. No. 4,676,310 patent comprises a sensor unit, a battery, and an electronic-controller to store measured data in an internal memory. Its locomotion unit consists of means to create a differential pressure in the fluid across the device using a piston-like movement. However its limited autonomy under down hole conditions is perceived as a major disadvantage of this device. Further restricting is the fact that the propulsion method employed requires a sealing contact with the surrounding wellbore. Such contact is difficult to achieve, particularly in unconsolidated, open holes.

Though not related to the technical field of the present invention, a variety of autonomous vehicles have been designed for use in oil pipe and sewer inspection. For example, in the European patent application EP-A-177112 and in the Proceeding of the 1993 IEEE/RSJ International Conference on Intelligent Robots and Systems, a robot for the inspection and testing of pipeline interiors is described. The robot is capable of traveling inside pipes with a radius from 520 mm to 800 mm.

In the U.S. Pat. No. 4,860,581, another robot comprising a main body mounted on hydraulically driven skids is described for operation inside pipes and bore holes.

In view of the known logging technology as mentioned above, it is an object of the present invention to provide a down-hole tool and method which is particularly suitable for deviated or horizontal wells.

SUMMARY OF THE INVENTION

The object of the invention is achieved by methods and apparatus as set forth in the appended claims.

An autonomous unit or robot according to the present invention comprises a support structure, a power supply unit, and a locomotion unit. The support structure is used to mount sensor units, units for remedial operations, or the like. The power supply can be pneumatic or hydraulic based. In a preferred embodiment, however, an electric battery unit, most preferably of a rechargeable type, is used.

The autonomous unit further comprises a logic unit which enables the tool to make autonomous decisions based on measured values of two or more parameters. The logic unit is typically one or a set of programmable microprocessors connected to sensors and actuators through appropriate interface systems. Compared to known devices, such as those described in U.S. Pat. No. 4,676,310, this unit provides a significantly higher degree of autonomy to the down hole tool. The logic unit can be programmed as a neural network or with fuzzy logic so as to enable a quasi-intelligent behavior under down hole conditions.

As another feature, the improved down hole tool comprises a locomotion unit which requires only a limited area of contact with the wall of the wellbore. The unit is designed such that, during motion, an essentially annular region is left between the outer hull of the autonomous unit and the wall of the wellbore. This allows well fluid to pass between the wall of the wellbore and the outer hull of tool. The essentially annular region might be off-centered during operation when, for example, the unit moves by sliding at the bottom of a horizontal well. Again compared to the device of U.S. Pat. No. 4,676,310, no sealing contact with the surrounding wall is required. Hence, the improved device can be expected to operate, not only in a casing but as well in an open hole environment.

Preferably, the locomotion unit is wheel or caterpillar based. Other embodiment may include several or a plurality of legs or skids. A more preferred variant of the locomotion unit comprises at least one propeller enabling a U-boat style motion. Alternatively, the locomotion unit may employ a combination of drives based on different techniques.

Among useful sensor units are: (1) flow measurement sensors, such as mechanical, electrical, or optical flow meters; (2) sonic or acoustic energy sources and receivers; (3) gamma ray sources and receivers; (4) local resistivity probes; and (5) images collecting devices—e.g., video cameras.

In a preferred embodiment, the robot is equipped with sensing and logging tools to identify the locations of perforations in the well and to perform logging measurements.

In variants of the invention the down hole tool comprises the autonomous unit in combination with a wireline unit which in turn is connected to surface.

The wireline unit can be mounted on the end of a drill pipe or coiled tubing device. However, in a preferred embodiment, the unit is connected to the surface by a flexible wire line and is lowered into the bore hole by gravity.

Depending on the purpose and design of the autonomous unit, the connection to the wireline unit provides either a solely mechanical connection to lower and lift the tool into or out of the well, or, in a preferred embodiment of the invention, means for communicating energy and/or control and data signals between the wireline unit and the robot. For the latter purpose, the connection has to be preferably repeatedly separable and re-connectable under down hole conditions—that is, under high temperature and immersed in a fluid/gas flow. In a preferred embodiment, the connection system includes an active component for closing and/or breaking the connection.

These and other features of the invention, preferred embodiments and variants thereof, possible applications thereof and advantages thereof will become appreciated and understood by those skilled in the art from the detailed description and drawings following below.

MODE(S) FOR CARRYING OUT THE INVENTION

Figure 1A:
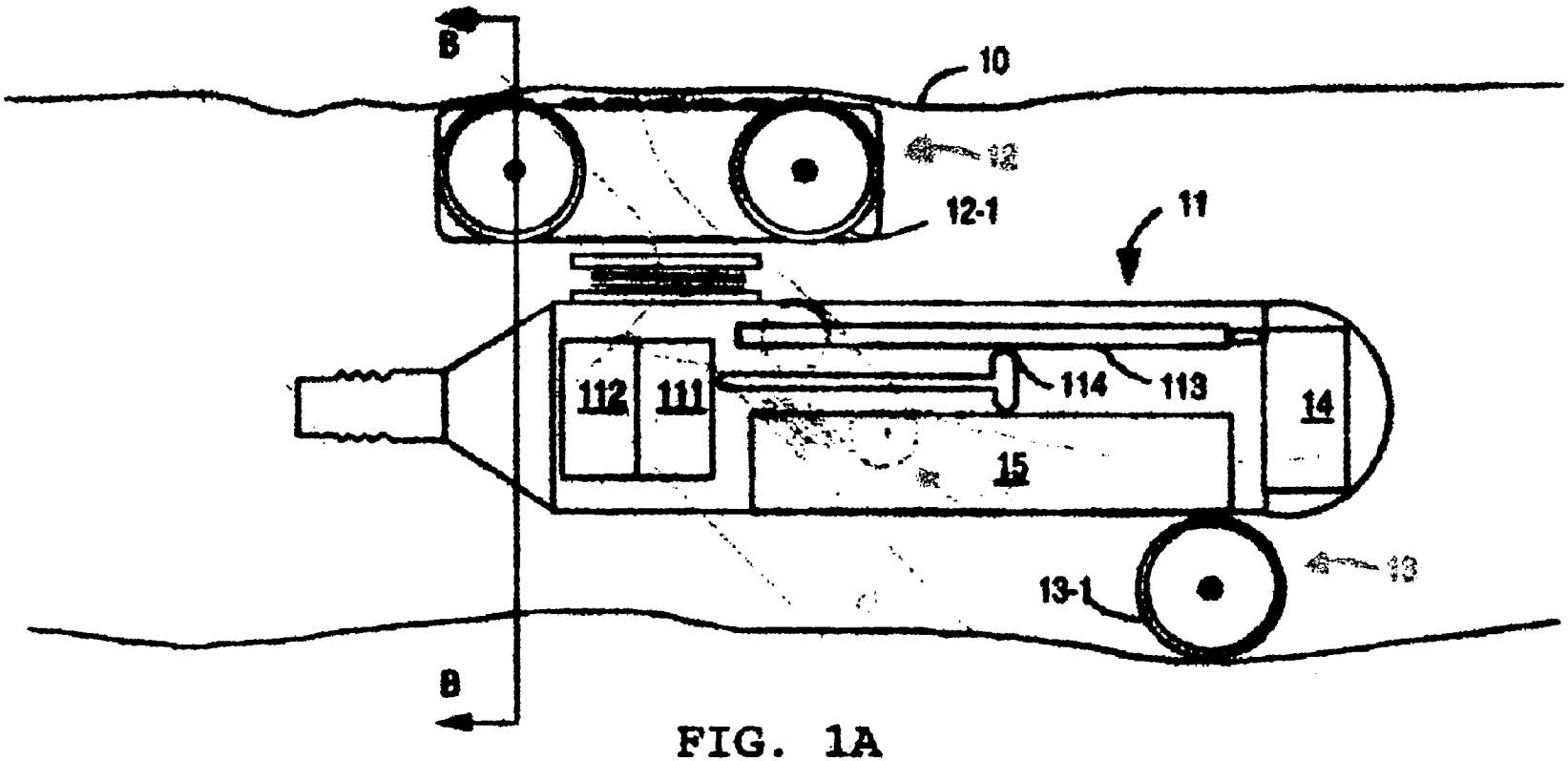
FIGS. 1A,B show (schematic) cross-sections of an autonomous unit of a down hole tool in accordance with the invention.
Figure 1B:
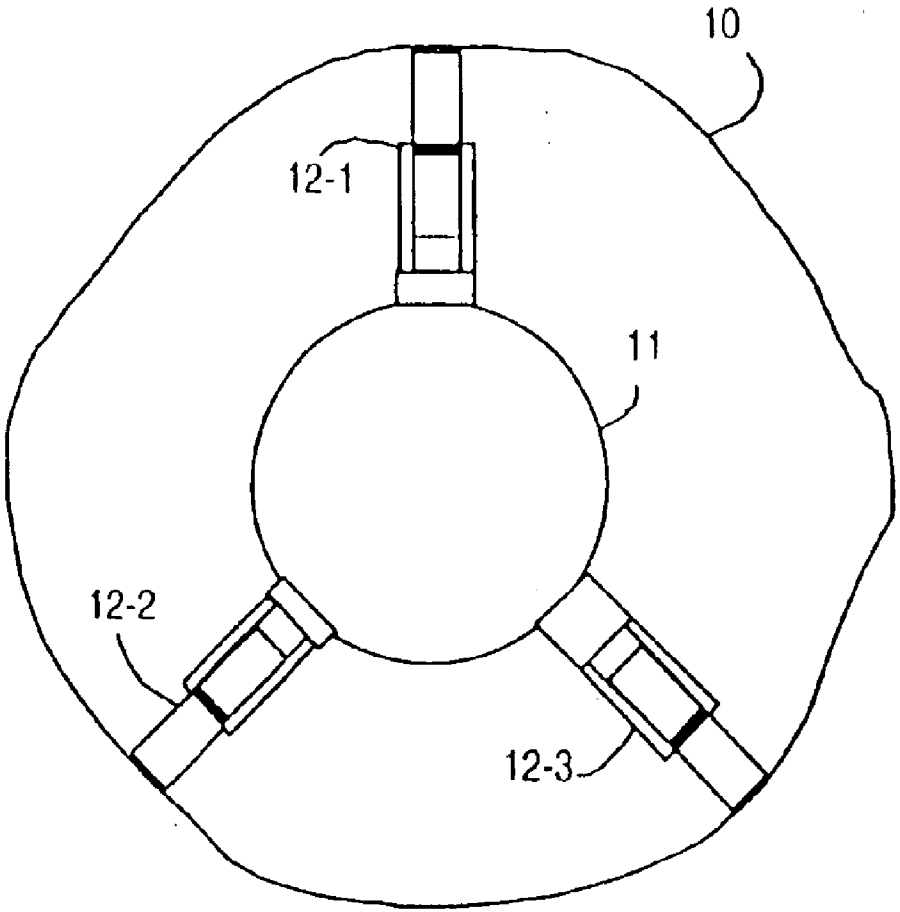

Referring to FIGS. 1A and 1B, an autonomous unit of a down hole tool in accordance with the invention has a main body 11 which includes an electric motor unit 111, a battery unit 112, and an on-board processing system 113. The battery unit 112 is interchangeable from a rechargeable lithium-ion battery for low-temperature wells (<60° C.) and a non-rechargeable battery for high-temperature wells (<120° C.). The autonomous unit is shown positioned within a bore hole 10.

In some cases, it may be necessary to enhance the battery unit with further means for generating power. Though for many cases it may suffice to provide an "umbilical cord" between a wireline unit and the autonomous unit, a preferred embodiment of the invention envisages power generation means as part of the autonomous unit. Preferably the additional power generation system extracts energy from surrounding fluid flow through the bore hole. Such a system may include a turbine which is either positioned into the fluid flow on demand, i.e., when the battery unit is exhausted, or is permanently exposed to the flow.

The on-board processing system or logic unit includes a multiprocessor (e.g., a Motorola 680X0 processor) that controls via a bus system 114 with I/O control circuits and a high-current driver for the locomotion unit and other servo processes, actuators, and sensors. Also part of the on-board processing is a flash memory type data storage to store data acquired during one exploration cycle of the autonomous unit. Data storage could be alternatively provided by miniature hard disks, which are commercially available with a diameter of below 4 cm, or conventional DRAM, SRAM, or (E)EPROM storage. All electronic equipment is selected to be functional in a temperature range of up to 120° C. and higher. For high-temperature wells it is contemplated to use a Dewar capsule to enclose temperature-sensitive elements such as battery or electronic devices.

The locomotion unit consists of a caterpillar rear section 12 and a wheel front section 13. As shown in FIG. 1B, the three caterpillar tracks 12-1, 12-2, 12-3 are arranged along the outer circumference of the main body separated by 120°. The arrangement of the three wheels 13-1, 13-2, 13-3 (one of which is shown in FIG. 1A) is phase-shifted by 60° with respect to the caterpillar tracks. The direction of the motion is reversed by reversing the rotation of the caterpillar tracks. Steering and motion control are largely simplified by the essentially one-dimensional nature of the path. To accommodate for the unevenness of the bore hole, the caterpillar tracks and the wheels are suspended.

The locomotion unit can be replaced by a fully wheeled variant or a full caterpillar traction. Other possibilities include legged locomotion units as known in the art.

The caterpillar tracks or the other locomotion means contemplated herein are characterized by having a confined area of contact with wall of the wellbore. Hence, during the motion phase an essentially annular region is left between the outer hull of the autonomous unit and the wall of the wellbore for the passage of well fluids.

Also part of the main body of the autonomous unit is a acoustic sensor system 14 (shown in FIG. 1A) which emits and receives ultrasonic energy. During operation, the acoustic sensor system 14 is used to identify specific features of the surrounding formation—e.g., perforations in the casing of the well.

The autonomous vehicle further comprises a bay section 15 for mounting mission specific equipment such as a flowmeter or a resistivity meter. In a preferred embodiment, the mission specific equipment is designed with a common interface to the processing system 113 of the autonomous unit. It should be appreciated that the mission specific equipment may include any known logging tools, tools for remedial operation, and the like, provided that the geometry of the equipment and its control system can be adapted to the available bay section. For most cases, this adaptation of known tools is believed to be well within the scope of an ordinarily skilled person.

Figure 2:
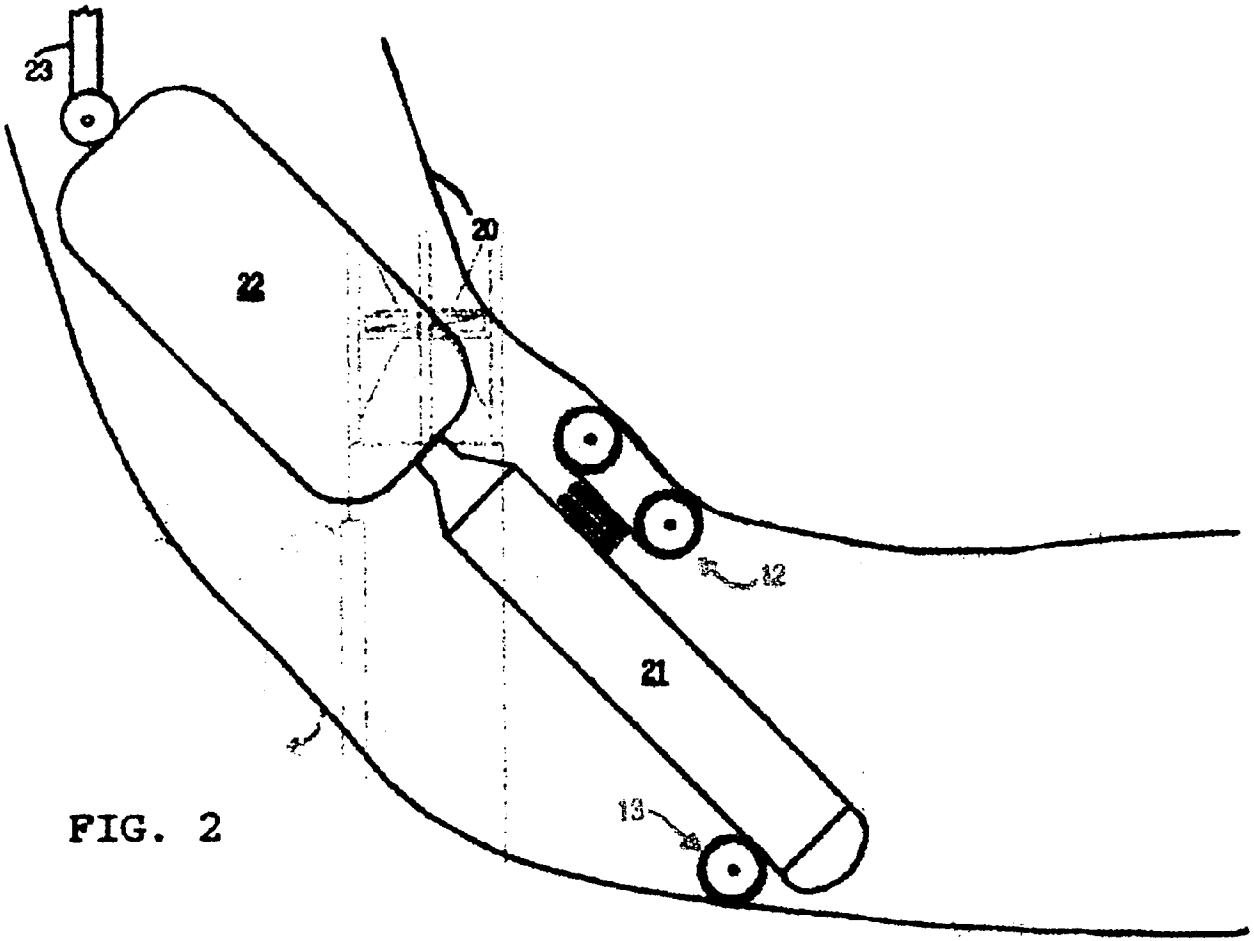
FIG. 2 illustrates the deployment of a down hole tool with an autonomous unit.

Referring now to FIG. 2, an autonomous unit or robot 21, as described above, is shown attached to a wireline unit 22 lowered by gravity into a wellbore 20. The wireline unit is connected via a wire 23 to the surface. Following conventional methods, the wire 23 is used to transmit data, signals, and/or energy to and from the wireline unit 22.

The combined wireline unit 22 and autonomous unit or robot 21, as shown in FIG. 2 can be deployed in an existing well on a wireline cable either to the bottom of the production tubing or as deep into the well as gravity will carry it. Alternatively, for a new well, the combined unit can be installed with the completion. In both cases the wireline unit 22 remains connected to the surface by a wireline cable capable of carrying data and power. In operation, the autonomous unit or robot 21 can detach from the wireline unit 22 using a connector unit described below in greater detail.

The robot can recharge its power supply while in contact with the wireline unit 22. It can also receive instructions from the surface via the wireline unit 22 and it can transmit data from its memory to the surface via the wireline unit 22. To conduct logging operations, the robot detaches from the "mother ship" and proceeds under its own power along the well. For a cased well, the autonomous unit or robot 21 merely has to negotiate a path along a steel lined pipe which may have some debris on the low side. Whereas the independent locomotion unit of the autonomous unit or robot 21 is described hereinbefore, it is envisaged to facilitate the return of the autonomous unit or robot 21 to the wireline unit 22 by one or a combination of a spoolable "umbilical cord" or a foldable parachute which carries or assists the robot on its way back.

In many production logging applications, the casing is perforated at intervals along the well to allow fluid flow from the reservoir into the well. The location of these perforations (which have entrance diameters of around ½") is sensed by the autonomous unit or robot 21 using either its acoustic system or additional systems, which are preferably mounted part of its pay-load, such as an optical fiber flowmeter or local resistivity measuring tools.

After having performed the logging operation, the measured data is collected in the memory of the autonomous unit or robot 21 and is indexed by the location of the perforation cluster (in terms of the sequence of clusters from the wireline unit 22). The autonomous unit or robot 21 can then move on to another cluster of perforations. The ability of the autonomous unit or robot 21 to position itself locally with reference to the perforations will also allow exotic measurements at the perforation level and repair of poorly performing perforations such as plugging off a perforation or cleaning the perforation by pumping fluid into the perforation tunnel. After certain periods, the length of which is mainly dictated by the available power source, the autonomous unit or robot 21 returns to the wireline unit 22 for data and/or energy transfer.

It may be considered useful to provide the autonomous unit or robot 21 with a telemetry channel to the wireline unit 22 or directly to the surface. Such a channel can again be set up by an "umbilical cord" connection (e.g., a glass fiber) or by a mud pulse system similar to the ones known in the field of Measurement-While-Drilling (MWD). Within steel casings, basic telemetry can be achieved by means for transferring acoustic energy to the casing (e.g., an electromagnetically driven pin, attached to or included in the main body of the autonomous unit or robot 21).

Complex down hole operations may accommodate several robots associated with one or more wireline units at different locations in the wellbore.

Figure 3:
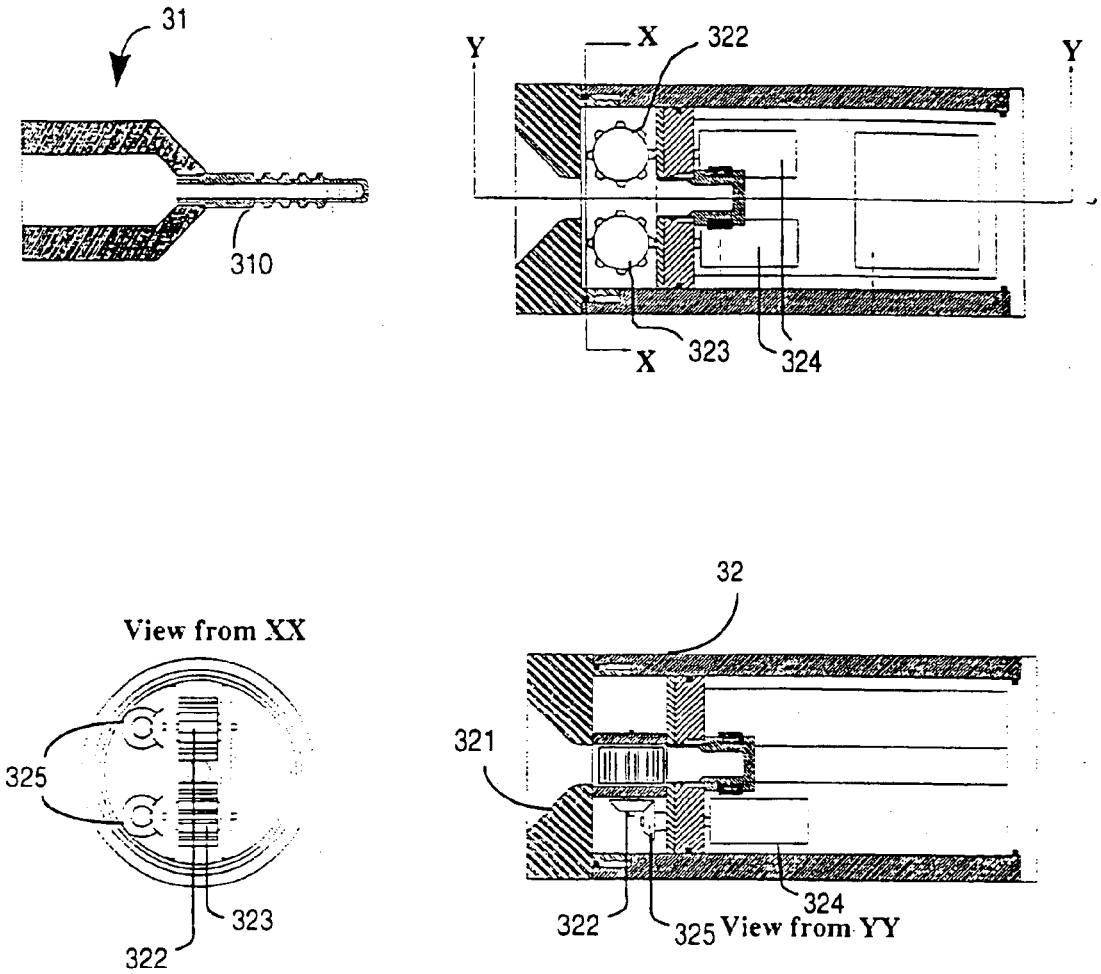
FIGS. 3, 4 depict and illustrate details of a coupling unit within a down hole tool in accordance with the present invention.
Figure 4:
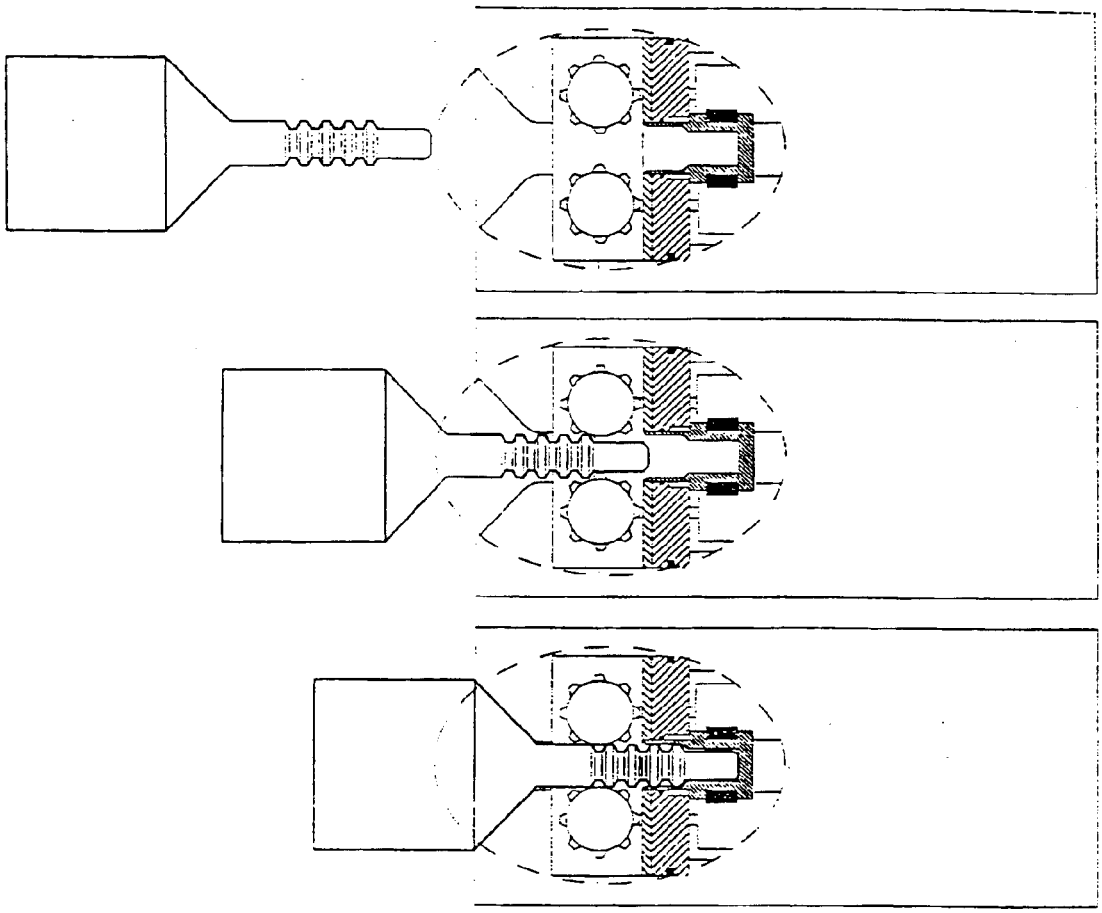

An important aspect of the example is the connection system between the wireline unit 22 and the autonomous unit or robot 21, illustrated by FIGS. 3 and 4. A suitable connection system has to provide a secure mechanical and/or electrical connection in a "wet" environment, as usually both units are immersed in an oil-water emulsion.

An example of a suitable connection mechanism is shown in FIG. 3. An autonomous unit 31 is equipped with a probe 310 the external surface of which is a circular rack gear which engages with a wireline unit 32. Both the wireline unit 32 and the autonomous unit 31 can be centralized or otherwise aligned. As the autonomous unit 31 drives towards the wireline unit 32, the probe 310 engages in a guide 321 at the base of the wireline unit 32 as shown. As the probe 310 progressively engages with the wireline unit 32, it will cause the upper pinion 322 to rotate. This rotation is sensed by a suitable sensor, and the lower pinion 323 (or both pinions) is, in response to a control signal, actively driven by a motor 324 and beveled drive gears 325 so as to pull the robot probe into the fully engaged position as shown in the sequence of FIG. 4. A latch mechanism then prevents further rotation of the drive pinions and locks the autonomous unit 31 to the wireline unit 32. In the fully engaged position, the two sections of an inductive coupling are aligned. Data and power can now be transmitted down the wireline, via the wireline unit 32 to the autonomous unit 31 across the inductive link. For higher power requirements, a direct electrical contact can be made in a similar fashion.

Figure 5A:
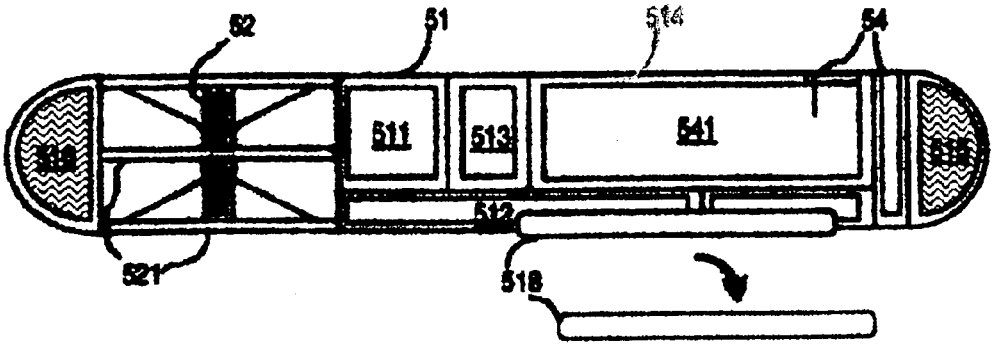
FIGS. 5A,B show (schematic) cross-sections of an autonomous unit of a down hole tool in accordance with the invention.
Figure 5B:
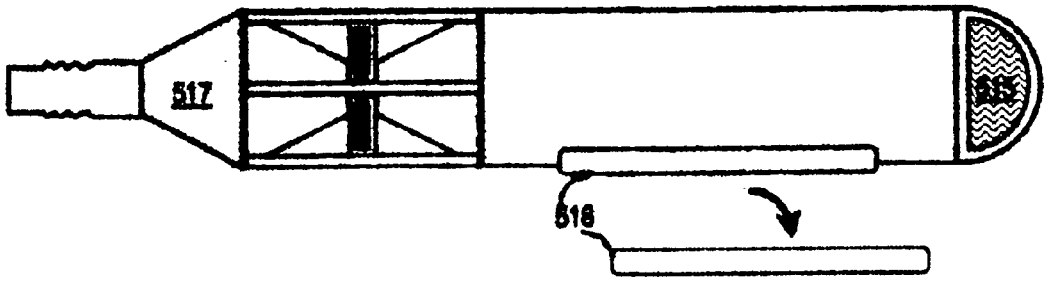

Referring now to FIGS. 5A and 5B, a further variant of the invention is illustrated.

The locomotion unit of the variant comprises a propeller unit 52, surrounded and protected by four support rods 521. The propeller unit 52 either moves in a "U-Boat" style or in a sliding fashion in contact with, for example, the bottom of a horizontal well. In both modes, an essentially annular region, though off-centered in the latter case, is left between the outer hull of the autonomous unit and the wellbore.

Further components of the autonomous unit comprise a motor and gear box 511, a battery unit 512, a central processing unit 513, and sensor units 54, including a temperature sensor, a pressure sensor, an inclinometer, and a video camera unit 541. The digital video is modified from its commercially available version (JVC GRDY1) to fit into the unit. The lighting for the camera is provided by four LEDs. Details of the processing unit are described below in connection with FIG. 6.

The main body 51 of the autonomous unit has a positive buoyancy in an oil-water environment. The positive buoyancy is achieved by encapsulating the major components in a pressure-tight cell 514 filled with gas (e.g., air or nitrogen). In addition, the buoyancy can be tuned using two chambers 515, 516, located at the front and the rear end of the autonomous unit.

FIGS. 5A,B illustrate two variants of the invention, one of which (FIG. 5A) is designed to be launched from the surface. The second (variant (FIG. 5B) can be lowered into the wellbore while being attached to a wireline unit. To enable multiple docking maneuvers, the rear buoyancy tank 517 of the latter example is shaped as a probe to connect to a wireline unit in the same way as described above.

During the descent through the vertical section of the borehole, the positive buoyancy is balanced by a ballast section 518. The ballast section 518 is designed to give the unit a neutral buoyancy. As the ballast section is released in the well, care has to be taken to select a ballast material which dissolves under down hole conditions. Suitable materials could include rock salt or fine grain lead shot glued together with a dissolvable glue.

Figure 6:
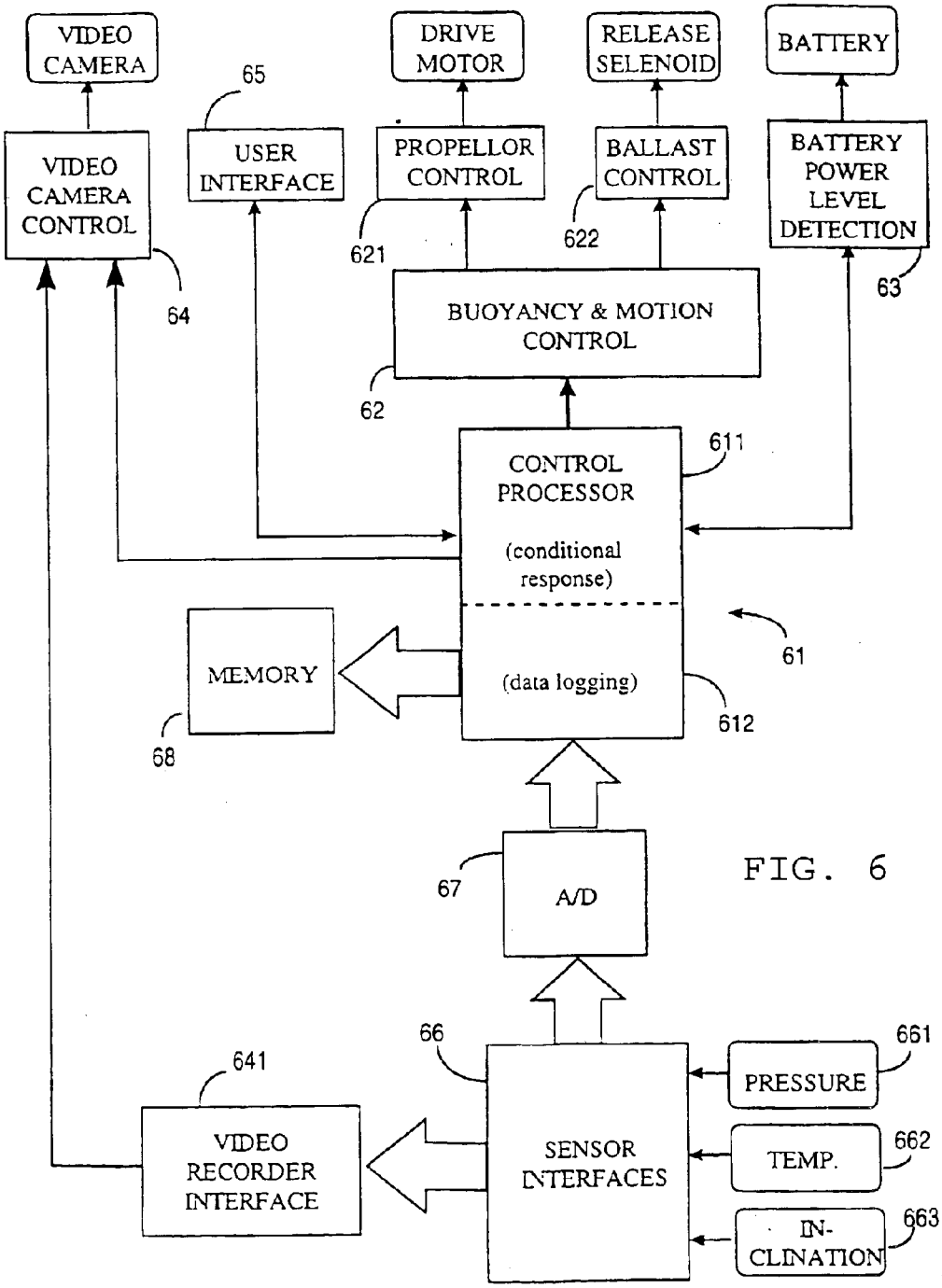
FIG. 6 illustrates major electronic circuitry components of the example of FIG. 5.

With reference to FIG. 6, further details of the control circuit system 513 are described.

A central control processor 61 based on a RISC processor (PIC 16C74A) is divided logically into a conditional response section 611 and a data logging section 612. The conditional response section 611 is programmed so as to control the motion of the autonomous unit via a buoyancy and motion control unit 62. Specific control units 621, 622 are provided for the drive motor and the release solenoids for the ballast section, respectively. Further control connections are provided for the battery power level detector unit 63 connected to the battery unit and the video camera control unit 64 dedicated to the operation of an video camera. The conditional response section 611 can be programmed through an user interface 65.

The flow and storage of measured data is mainly controlled by the data logging section 612. The sensor interface unit 66 (including a pressure sensor 661, a temperature sensor 662, and an inclinometer 663) transmits data via A/D converter unit 67 to the data logging section 612 which stores the data in an EEPROM type memory 68 for later retrieval. In addition, sensor data are stored on the video tape of the video camera via a video recorder interface 641.

An operation cycle starts with releasing the autonomous unit from the wellhead or from a wireline unit. Then, the locomotion unit is activated. As the horizontal part of the well is reached, the pressure sensor 661 indicates an essentially constant pressure. During this stage the autonomous unit can move back and forth following instructions stored in the control processor 61. The ballast remains attached to the autonomous unit during this period. On return to the vertical section of the well, as indicated by the inclinometer 663, the ballast 518 is released to create a positive buoyancy of the autonomous unit. The positive buoyancy can be supported by the propeller 52 operating at a reverse thrust.

The return program is activated after (a) a predefined time period or (b) after completing the measurements or (c) when the power level of the battery unit indicates insufficient power for the return trip. The conditional response section 611 executes the instructions according to a decision tree programmed such that the return voyage takes priority over the measurement program.

The example given illustrates just one set of the programmed instructions which afford the down hole tool full autonomy. Other instructions are, for example, designed to prevent a release of the ballast section in the horizontal part of the wellbore. Other options may include a docking program enabling the autonomous unit to carry out multiple attempts to engage with the wireline unit. The autonomous unit is thus designed to operate independently and without requiring intervention from the surface under normal operating conditions. However, it is feasible to alter the instructions through the wireline unit during the period(s) in which the autonomous unit is attached or through direct signal transmission from the surface.

It will be appreciated that the apparatus and methods described herein can be advantageously used to provide logging and remedial operation in horizontal or high-angle wells without a forced movement (e.g., by coiled tubing) from the surface.

What is claimed is:

1. A down hole apparatus comprising:

a body adapted to operate in a bore hole without a wired connection to the surface;

a power supply located within the body; and a control system located within the body and designed such that while the body is operating in a bore hole without a wired connection the apparatus can operate independently without requiring intervention from the surface.

2. The apparatus of claim 1 wherein the control system comprises a processor that is programmed as a neural network or with fuzzy logic so as to enable a quasi-intelligent behavior under down hole conditions.

3. The apparatus of claim 1 wherein the apparatus is adapted for operating neutrally buoyant.

4. The apparatus of claim 3 wherein the apparatus further comprises a ballast system designed to give the apparatus neutral buoyancy.

5. The apparatus of claim 4 wherein the ballast system is adapted to release ballast material from the apparatus during operation.

6. The apparatus of claim 1 further comprising a power generation system in electrical communication with the power supply.

7. The apparatus of claim 6 wherein the power supply comprises a battery and the power generation system is adapted and arranged to charge the battery.

8. The apparatus of claim 7 wherein the power generation system extracts energy from surrounding fluid in the bore hole.

9. The apparatus of claim 8 wherein the power generation system comprises a turbine which is adapted to extract energy by being exposed to the surrounding fluid.

10. The apparatus of claim 1 wherein the body is adapted to be deployed in the bore hole through the use of a deployment vehicle.

11. The apparatus of claim 10 wherein the deployment vehicle is a wireline unit.

12. A down hole system comprising a plurality of apparatuses according to claim 1.

13. The down hole system of claim 12 wherein the system is designed to carry out complex downhole operations by using the plurality of apparatuses.

14. The down hole system of claim 13 wherein the plurality of apparatuses are deployed in the bore hole using one or more deployment vehicles.

15. The downhole system of claim 14 wherein the one or more deployment vehicles are wireline units.

16. A method for operating a down hole apparatus comprising:

deploying the apparatus in a bore hole;

operating the apparatus in the bole hole without a wired connection to the surface the apparatus including a power supply located within the apparatus, and a control system within the apparatus designed such that the apparatus can operate independently without requiring intervention from the surface; and retrieving the apparatus from the bore hole.

17. The method of claim 16 wherein the control system comprises a processor that is programmed as a neural network or with fuzzy logic so as to enable a quasi-intelligent behavior under down hole conditions.

18. The method of claim 16 wherein the step of operating comprises operating the apparatus in a neutrally buoyant manner.

19. The method of claim 18 wherein the step of operating further comprises releasing ballast material from the apparatus during operation.

20. The method of claim 16 further comprising the step of generating electrical power and charging a battery associated with the apparatus.

21. The method of claim 20 wherein the step of generating electrical power comprises extracting energy from surrounding fluid in the bore hole using a turbine exposed to the surrounding fluid.

22. The method of claim 16 wherein the step of deploying is carried out through the use of a deployment vehicle.

23. The method of claim 22 wherein the deployment vehicle is a wireline unit.

24. The method of claim 22 wherein the step of retrieving the apparatus is carries out through the use of the deployment vehicle.

* * * * *